US005263418A

United States Patent [19]

Dippold et al.

[11] Patent Number: 5,263,418

[45] Date of Patent: Nov. 23, 1993

[54] HOLLOW POINT SABOT BULLET

[75] Inventors: Jack D. Dippold, Edwardsville, Ill.; Scott H. Mayfield, St. Louis, Mo.

[73] Assignee: Olin Corporation, Cheshire, Conn.

[21] Appl. No.: 825,369

[22] Filed: Jan. 24, 1992

[51] Int. Cl.[5] ..... F42B 12/34; F42B 14/06

[52] U.S. Cl. ..... 102/509; 102/521

[58] Field of Search ..... 102/507-510, 102/520-523

[56] References Cited

U.S. PATENT DOCUMENTS

| | | | |
|---|---|---|---|
| 2,838,000 | 6/1958 | Schreiber | 102/507 |
| 3,726,231 | 1/1973 | Kelly et al. . | |
| 3,881,421 | 5/1975 | Burczynski . | |
| 4,336,756 | 6/1982 | Schreiber | 102/507 |
| 4,550,662 | 11/1975 | Burczynski . | |
| 5,012,744 | 5/1991 | Sowash . | |
| 5,016,538 | 5/1991 | Sowash . | |
| 5,079,814 | 1/1992 | Moore et al. | 102/509 |

FOREIGN PATENT DOCUMENTS

| | | | |
|---|---|---|---|
| 5230 | of 1885 | United Kingdom | 102/507 |
| 4426 | of 1899 | United Kingdom | 102/507 |

*Primary Examiner*—Harold J. Tudor
*Attorney, Agent, or Firm*—John R. Wahl

[57] ABSTRACT

A sabot bullet is disclosed having a front conical part and a rear conical part converging towards each other and joined by an integral interconnecting part having a smooth outer surface joining with the adjacent ends of the conical front and rear parts. The front conical part has a forwardly open empty recess having flat side walls and a polygonal radial cross section in the front end thereof.

12 Claims, 1 Drawing Sheet

HOLLOW POINT SABOT BULLET

RELATED APPLICATIONS

This application is related to U.S. Pat. Nos. 5,012,744 and 5,016,538.

BACKGROUND OF THE INVENTION

Field of the Invention

This invention relates generally to sabot bullets and more particularly to a sabot bullet having a hollow point

Description of the Related Art

Sabot bullets have been known and used for a number of years. One such sabot bullet is disclosed in U.S. Pat. No. 3,726,231 and the patents referred to above, specifically U.S. Pat. Nos. 5,012,744 and 5,016,538. These patents disclose a sabot bullet in which the bullet body has two conical parts joined together and integral with each other. The two conical parts diverge outwardly so as to have an hour glass or constricted waist shape. While this construction of a sabot bullet body has been very satisfactory in terms of accuracy, expansion of the bullet in soft body tissue upon upset has proven to be relatively limited. One solution to this limited expansion is to provide a hollow point on the bullet such as is disclosed in either U.S. Pat. No. 4,550,662 or U.S. Pat. No. 3,881,421 both of which were issued to Burczynski. The first of these Patents discloses a projectile with a deep star shaped hollow point having a plurality of circumferentially spaced ribs.

The other patent, U.S. Pat. No. 3,881,421, discloses a hollow point with a central nub or projection protruding from the base of the hollow point. This design is stated to increase the basic expansion of the bullet in soft body tissue. However, the expansion is uniform around the circumference of the bullet. This tends to limit the amount of tissue damage which occurs upon upset.

Accordingly, there remains a need for a sabot projectile design with a constricted waist which has an improved expansion performance in soft body tissue and which produces increased tissue damage upon penetration without fragmentation.

SUMMARY OF THE INVENTION

The sabot bullet of the present invention meets the above identified needs. The constricted waist sabot bullet has a tapered axial recess in the front end having flat tapered side walls with generally sharp corners so as to have a polygonal radial cross section. This substantially improves expansion of the bullet upon upset in soft body tissue.

The sabot bullet having a polygonal sided recess axially extending into the nose portion or front end of the bullet mushrooms, splits at the corners and expands upon upset forming spaced petals which tend not to separate from the body of the bullet. The flat side walls limits the amount of metal in the petal so as to minimize the tendancy to fragment near the constricted waist. Instead, these petals curl outwardly and rearwardly, increasing the outer diameter of the bullet while at the same time enhancing the cutting and tearing action of the bullet as it passes through soft body tissue. This in turn increases the hemorrhaging effect on the animal and enhances the probability of a clean kill.

DETAILED DESCRIPTION OF THE INVENTION

Figure 1:
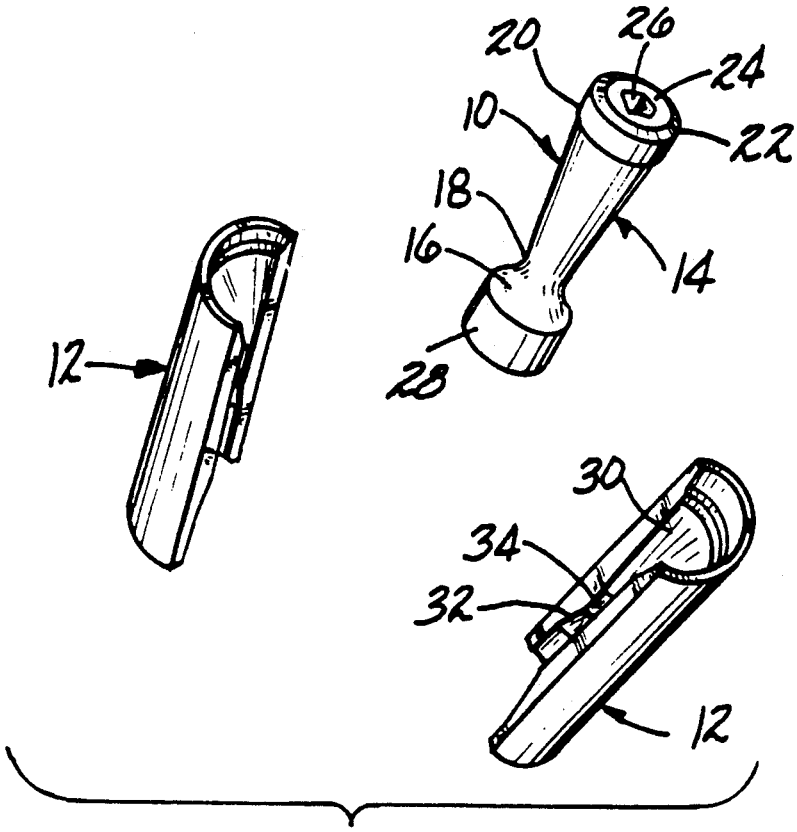
FIG. 1 is an exploded view of the sabot segments and bullet of the invention.

The sabot bullet 10 of the invention is shown in FIG. 1 along with sabot segments 12. The sabot bullet 10 comprises a preferably swaged heavy metal bullet body having a pair of axially aligned conical parts 14 and 16 adjacent to and spaced apart from each other. Each conical part 14 and 16 increases in diameter as the conical parts extend away from each other. The conical parts 14 and 16 are joined by an integral interconnecting part 18 which merges smoothly with the outer surfaces of the adjacent ends of the conical parts 14 and 16. Front part 14 has a cylindrical end portion 20 which has a ogival or conical front end 22. Front end 22 terminates in a generally flat face 24. Centrally disposed through flat end face 24 is a central open recess 26 having a generally truncated tapered shape with a polygonal radial cross section. The recess has axially extending tapered sidewalls. The rear conical part 16 of the sabot bullet 10 terminates in a cylindrical portion 28. The bullet body 10 is swaged from a lead alloy wire blank which contains from about 2% to about 6% antimony and preferably about 2.5% antimony.

Each sabot segment 12 is form fit to compliment the outer surface of the sabot bullet 10. More specifically, each sabot segment has spaced generally conical inner surface Portions which converge towards each other and are connected together by an outwardly convex annular connecting portion 34. The sabot segments are made of a light weight plastic material such as a polypropylene or polyethylene.

Figure 2:
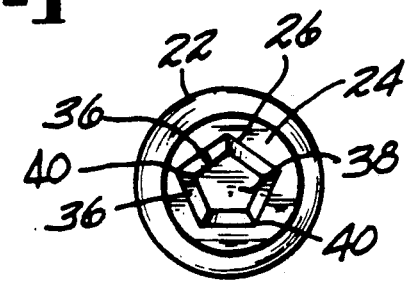
FIG. 2 is an end view of the bullet of the invention.

Referring now to FIG. 2, the front end 22 of the sabot bullet 10 has a flat end face 24 and a centrally disposed polygonal recess 26. The recess 26 has straight, tapered, flat side walls 36 which preferably form a large pentagon shape at surface 26 and a smaller pentagon shape at the bottom 38 of the recess 26. The bottom 38 may be substantially flat or it may be curved or rounded as in a dish. If flat, the corners of the polygon shaped bottom 38 are preferably spherically radiused.

Figure 3:
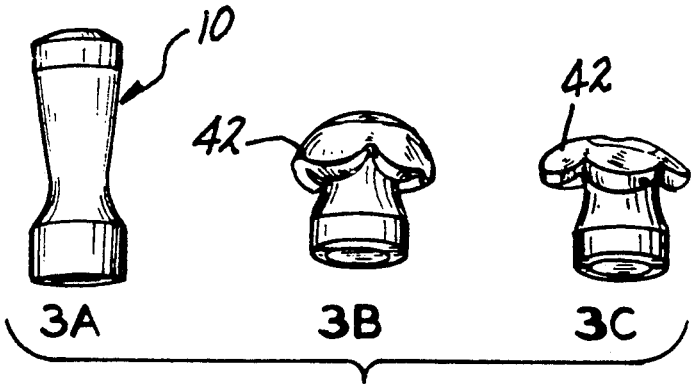
FIGS. 3*a*, 3*b*, and 3*c* are side views of the bullet in FIG. 1 unfired, upset at 50 yards, and at 100 yards respectively.

Each flat side wall 36 joins with an adjacent side wall 36 at a corner 40. The corners 40 are preferably substantially sharp. Upon impact of the sabot bullet 10 in soft body tissue or, simulated by gelatin, the corners 40 split as the ogival end 22 folds backwards and expands to form petals 42 as are shown in FIGS. 3B and 3C.

It has been found that the recess 26 having flat side walls provides a uniform expansion upon upset with the formation of petals that tend to stay attached to the body of conical part 14 during penetration. However, if recess 26 extends too deeply into conical part 14, the front end of the bullet 10 does separate into fragments. Accordingly, it has been discovered that the optimum expansion can be obtained with a recess depth of between 0.10 and 0.25 inches. For a sabot bullet designed for use in a 12 gauge shotgun, for example, the preferred depth is about 0.16 inches, which corresponds approximately to the length of the cylindrical portion 20.

While the invention has been described above with reference to specific embodiments thereof, it is apparent that many changes, modifications, and variations can be made without departing from the invented concept disclosed herein. For example, the sabot bullet 10 may have a central recess having a tetragonal or triangular cross section rather than a pentagon as shown. In addition, a hexagon cross section may also be utilized. Accordingly, it is intended to embrace all such changes, modifications, and variations that follow in the spirit and broad scope of the appended claims. All patent applications, patents and other publications cited herein are incorporated by reference in their entirety.

What is claimed is:

1. A sabot bullet comprising:

a bullet body having a pair of axially aligned conical parts having a smooth outer surfaces converging toward each other and spaced apart from each other by a connecting part, a front one of said conical parts having a forwardly open tapered completely empty recess inwardly tapered toward its base extending substantially into a front end thereof, said recess having flat side walls; and a plurality of sabot segments positioned around said bullet body, each of said segments having an internal surface shape complementary to said outer surface of said bullet body.

2. The sabot bullet according to claim 1 wherein said recess has a polygonal radial cross section.

3. The sabot bullet according to claim 2 wherein said recess has a substantially flat bottom.

4. The sabot bullet according to claim 2 wherein said recess has a pentagonal radial cross section.

5. The sabot bullet according to claim 4 wherein said recess has a depth of between 0.1 inches and 0.25 inches.

6. The sabot bullet according to claim 5 wherein said recess has a depth of about 0.16 inches.

7. A sabot bullet comprising:

a bullet body having a pair of axially aligned conical parts having smooth outer surfaces converging toward each other and spaced apart from each other by a connecting part having a rounded outer surface portion which merges smoothly with the outer surfaces of the adjacent ends of the conical parts, a front one of said conical parts having a forwardly open completely empty recess inwardly tapered toward its base extending substantially into a front end thereof, said recess having flat side walls; and a plurality of sabot segments positioned around said bullet body, each of said segments having an internal surface shape complementary to said outer surface of said bullet body.

8. The sabot bullet according to claim 7 wherein said recess has polygonal radial cross section.

9. The sabot bullet according to claim 8 wherein said recess has a substantially flat bottom.

10. The sabot bullet according to claim 8 wherein said recess has a pentagonal radial cross section.

11. The sabot bullet according to claim 9 wherein said recess has a depth of between 0.1 inches and 0.25 inches.

12. The sabot bullet according to claim 11 wherein said recess has a depth of about 0.16 inches.

* * * * *